United States Patent [19]

Lemelson

[11] 3,933,311

[45] Jan. 20, 1976

[54] EXTRUDED FENCE

[76] Inventor: Jerome H. Lemelson, 85 Rector St., Metuchen, N.J. 08840

[22] Filed: May 17, 1973

[21] Appl. No.: 361,049

Related U.S. Application Data

[63] Continuation-in-part of Ser. No. 265,281, June 22, 1972.

[52] U.S. Cl. ..... 239/276; 239/289; 256/1; 256/24

[51] Int. Cl.[2] ..... B05B 9/00

[58] Field of Search ..... 256/1, 59, 24; 239/208, 239/273, 276, 289; 137/356

[56] References Cited

UNITED STATES PATENTS

| | | | |
|---|---|---|---|
| 3,107,900 | 10/1963 | De Paolo | 256/59 X |
| 3,332,667 | 7/1967 | Armstrong | 256/24 X |
| 3,425,630 | 2/1969 | Fessler | 256/1 X |
| 3,472,272 | 10/1969 | Bertics et al. | 137/356 |
| 3,579,908 | 5/1971 | Morgan | 256/48 X |
| 3,610,249 | 10/1971 | Baker | 160/229 R |
| 3,648,981 | 3/1972 | Allen | 256/59 X |
| 3,701,477 | 10/1972 | Matt et al. | 256/1 X |
| 3,711,066 | 1/1973 | Niemiec | 256/24 X |
| 3,865,309 | 2/1975 | Greenhalgh | 256/1 X |

FOREIGN PATENTS OR APPLICATIONS

| | | | |
|---|---|---|---|
| 1,006,996 | 10/1965 | United Kingdom | 256/59 |
| 1,160,275 | 8/1969 | United Kingdom | 256/59 |

*Primary Examiner*—Dennis L. Taylor

[57] ABSTRACT

A fence structure is provided which is produced of a plurality of lengths of plastic or metal extrusions joined together to form a tandem array of interconnected sections. In one form, the joining means serves one or more functions in addition to that of connecting the fence sections together. A particular form of joining means for the fence sections is also operable to secure the fence to the ground.

In a particular construction, the fence is formed with one or more tubular formations extending longitudinally thereof and the tubular formations of each section of fence are interconnected with those of the other sections by means of the joining means.

10 Claims, 5 Drawing Figures

EXTRUDED FENCE

RELATED APPLICATIONS

This is a continuation-in-part of application Ser. No. 265,281 filed June 22, 1972, and entitled Fence Structures.

SUMMARY OF THE INVENTION

This invention relates to new and improved structures in fencing, particularly those which are produced by extruding the fence of plastic polymers or certain, lightweight and inexpensive metals such as aluminum.

Heretofore, most fencing was produced by assembling a plurality of separate components such as wire mesh or other formations of wire, wood or other suitable material and joining the separate elements thereof by welding, fasteners or other suitable means. It is obvious that such structures are relatively complex, require special costly machinery to produce and are difficult to install.

The instant invention is concerned primarily with new and improved structures in fencing, which may be easily assembled and which may serve additional functions such as irrigating grass, shrubbery or flowers disposed adjacent to the fence.

Accordingly, it is a primary object of this invention to provide new and improved structures in fencing which may be easily fabricated at low cost.

Another object is to provide improved structures in fencing which may be easily assembled at the location of its use and erected or supported above the ground.

Another object is to provide an improved fence structure which requires little or no assembly for the sections thereof, which sections may be easily assembled together.

Another object is to provide an improved, unitary fence structure which may also be utilized to conduct and dispense water therefrom.

Another object is to provide an improved coupling means for sections of fence, which coupling means, in addition to serving to secure sections of fence together, also serves to secure the assembled fence sections to the ground.

With the above and such other objects in view as may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

Figures 1, 2, 3, 4, 5:
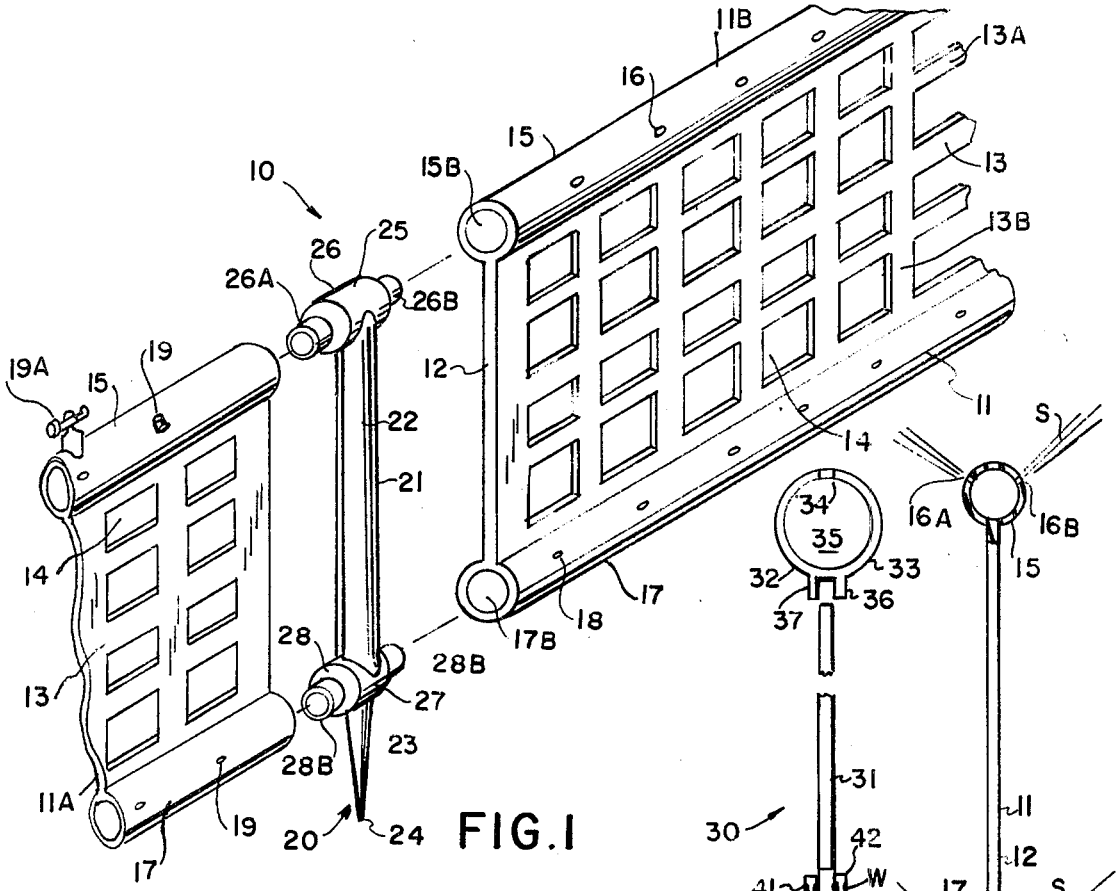
FIG. 1 is an isometric view of sections of fencing embodying features of the instant invention and a coupling member for two sections thereof which coupling member also serves additional functions.
FIG. 2 is an end view of the sections of fencing of FIG. 1.
FIG. 3 is an end view of another structure defining a modified form of the fence structure of FIG. 2.
FIG. 4 is a side cross-sectional view of one of the fittings provided in FIG. 1 for holding sections of fencing together.
FIG. 5 is a side view showing a plurality of sections of fencing of the type shown in FIG. 1 assembled together.

There is shown in FIG. 1 several components of a plastic fence structure comprising an assembly 10 of a plurality of lattice-like units 11 of fence, which units are preferably formed by extruding a plastic or metal into an elongated shape having a central portion 12 formed with a sheet-like wall 13 having openings 14 therein, shown of rectangular shape, and integrally extruded with tubular formations 15 and 17 which respectively define the upper and lower borders of each fence unit 11. The tubular formations 15 and 17 are thus formed by co-extruding same with the central portion 12 to form a unitary extrusion thereof while the openings 14 may be formed in the sheet-like wall 13 of the central portion 12 by any suitable means such as die cutting or extrusion forming same. Notations 13A and 13B refer respectively to the longitudinal and lateral strip-like portions which define the central portion 12 and border the openings 14 therein.

The tubular formations 15 and 17 serve a number of purposes, in addition to defining the upper and lower portions of the fence units 11. While said formations may be primarily employed to longitudinally stiffen and support the central lattice-like portion 12 of the fence, either or both the tubular formations 15 and 17 may also serve as receptacles for coupling members 20 of the type illustrated, which coupling members connect the ends of each two fence units denoted 11A and 11B together and also serve to support the connected units above the ground as will be described. Either or both the tubular formations 15 and 17 may also serve another important function, that of conducting a fluid therethrough. Water, for example, may be pumped through either or both the tubular formations 15 and 17 and dispensed as a plurality of sprays or streams S through respective rows of holes 16 and 18 provided longitudinally along the sidewalls of the respective tubular formations or from nozzles 19 located within said holes, to irrigate adjacent grass, shrubbery or flowers growing adjacent to the fence 10.

As shown in FIG. 2, the tubular formations 15 and 17 may have their water dispensing holes directed towards both sides of the fence. Holes 16A and 16B are provided in opposite sides of formation 15 and are directed to form streams of water which shoot upwardly and outwardly to both sides thereof. Holes 18A and 18B in opposite sides of tubular formation 17, direct streams of water upwardly and outwardly of the formation to wet surroundings closer to the fence than holes 16A and 16B. All the holes along a section 11 of fence may be so directed and dimentioned or contain different nozzles, which, when a particular fluid pressure is applied to the liquid within the tubular formations, serve to substantially wet respective bands of foliage and grass on both sides of the fence 10. Certain of the holes may contain nozzles adapted to generate particular shaped sprays or direct water further from the fence while others may also be closed by plugs inserted by the installer of the fence in the event that it is not desired to direct water through all the holes. In another embodiment, notation 19A refers to one or more rotating spray generating devices located along one or more of the fence sections 11 and preferably connected to the upper tubular formation 15 to suitably spray water to surroundings.

The coupling member 20 of FIG. 4 comprises a casting, molding or assembly 21 having a central shank or tubular formation 22, a lower portion 23 which is tapered to a pointed end 24 to permit it to be pushed into the ground, an upper portion 25 which is formed with a tubular formation 26 containing portions 26A and 26B which protrude outwardly from opposite sides of the shank 22 and a portion 27 joining shank 22 to said tapered lower portion 23 and also defining a second tubular formation 28 to member 20. Tubular formation 28 has respective end portions 28A and 28B which, like portions 26A and 26B, protrude outwardly from opposite sides of shank 22. Formations 26A and 28A are shaped to slide assemble in the bores 15B and 17B of the tubular formations 15 and 17 of one of the lengths 11A of fence 10 [e.g., unit 11A of FIG. 1], while formations 26B and 28B are shaped to slide fit in the bores of similar tubular formations in another length 11B of fence adapted to be assembled with the length thereof assembled to the opposite side of member 20. If the fence units 11 and coupling units 20 or the tubular formations 26 and 28 thereof are made of a thermoplastic resin such as rigid polyvinyl chloride, cellulose acetate butyrate or other suitable resin, a solvent may be employed between the mating surfaces to bond same so as to join lengths of the fencing together; otherwise adhesives, welding or gasketing may be employed to provide assembly 9 as shown in FIG. 3. In FIG. 5, a fence assembly 10′ comprises a plurality of lattice-like fence units 11C, 11D, 11E, etc., which are joined, end-to-end, together by respective coupling members 20, which, as indicated above, also fluidically connect the upper and lower tubular formations of each fence unit together to permit water to be flowed the entire length of the fence.

The central portions 13C, 13D and 13E of the three fence units 11C, 11D, and 11E shown in FIG. 5 each contain circular openings 14A therein rather than the rectangular openings 14 shown in FIG. 1. The individual coupling members 20, two of which denoted 20A and 20B are shown, are made in accordance with the structure shown in FIG. 4 and each has its upper and lower tubular formations adhesively or weldably secured to and projecting within the ends of the respective upper and lower tubular formations of the fence units. The units 11C, 11D, 11E, etc., of FIG. 5 may be produced of respective single extrusions of plastic or metal as shown in FIG. 2 or assemblies of several components such as illustrated in FIG. 3. The fence unit 30 of FIG. 3 comprises a central sheet-like lattice formation 31, preferably of rectangular shape and having its upper and lower edges secured to specially shaped tubular extrusions 32 and 38. Extrusion 32 is formed with a cylindrical wall portion 33 and has protruding downwardly therefrom respective strip-like formations 36 and 37 between which is formed a channel into which the upper edge portion of the sheet-like formation 31 is inserted and bonded or welded thereto. Liquid forced through passageway 35 in the tubular formation 32 is ejected from holes 34 which are punched or drilled in the upper portion of the tube.

Tubular formation 38 has a cylindrical side wall which is extrusion formed with a pair of strip-like formations 41 and 42 protruding upwardly therefrom and providing a channel in which the lower edge of the sheet-like formation 31 is inserted and bonded or welded thereto along respective sealing lines W extending the length of the fence unit. The passageway 40 extending through the tubular formation 38 may be employed to carry a liquid such as water therethrough for irrigation purposes either with respect to land surrounding the fence when the water is ejected through holes therein as described or to a distant portion of the fence or other irrigation system connected thereto.

While the fence units 11 of the type shown in FIG. 1 may be completely produced by extrusion while controlling and varying the openings in a suitable die to form openings 14 and operating on the extrusion by drilling or other means to form orifices 16 and 18, such fence units as well as that illustrated in FIG. 5 may be produced by extruding the central sheet-like portions of the fence from a solid sheet and continuously die cutting openings 14 and 14A therein, which operation preferably includes recycling the material which is removed to the extruder or a compounding unit feeding the extruder. Extrusion means such as provided in my U.S. Pat. No. 3,422,648 may be employed to form lengths of fence units of the type shown in FIGS. 1 and 2, while injection, blow molding or casting means may be employed to form the coupling members 20 of plastic or metal.

In FIG. 5, notation 51 refers to a tubular fluid connector or fitting which is secured to or formed as part of the lower tubular formation 28 of coupling member 20B. Connector or fitting 51 may be externally threaded and adapted to receive the end coupling of a garden hose or pipe which is connected at its other end to a source of water such as a nozzle outlet from a water supply pipe, to supply water to the lower tubular formation of the fence. A similar fitting or connector may be provided at the upper end of the coupling member 20B to supply water to the upper tubular formation. In another construction, the coupling member 20 of FIG. 4 may contain a passageway therein extending between the lower tubular formation 28 and the upper tubular formation 26 so that a single inlet to formation 28 may be utilized to conduct water to both the upper and lower tubular formations extending longitudinally along the assembled fence.

I claim:

1. A fence assembly comprising in combination:

a plurality of fence sections each having a central lattice-like portion, each of said fence sections having upper and lower tubular formations integral with the central portion thereof with at least one of said tubular formations of each of said fence sections being adapted to carry an irrigation fluid, said tubular formations extending parallel to each other and longitudinally along said central portion from one end of said central portion to the other end thereof, coupling means provided between each of said fence sections for joining said fence sections together, said coupling means comprising respective elongated members having respective connection formations respectively secured to the ends of each of the longitudinally extending upper and lower tubular formations of respective aligned fence sections, portions of at least certain of said coupling means protruding downwardly from said fence sections and being secured beneath said fence sections to the ground so as to support said fence sections above the ground and said coupling means including means for fluidically connecting the irrigation fluid carrying tubular formations of each of said fence sections to those of the adjacent fence sections.

2. A fence assembly in accordance with claim 1 wherein said tubular formations of said fence sections which carry said irrigation fluid are each formed with a plurality of holes along its length for permitting the escape of fluid therefrom for irrigating areas adjacent to said fence sections.

3. A fence assembly in accordance with claim 1 wherein both of said tubular formations of each of said fence sections are adapted to carry irrigation fluid and each of said coupling means is operable to fluidically connect the respective tubular formations of one fence section with those of the next fence section connected to said coupling means.

4. A fence assembly in accordance with claim 1 wherein said tubular formations of each fence section extend respectively along the upper and lower borders of the central portion of said fence section and each is adapted to conduct an irrigation fluid therethrough, each of said tubular formations of each of said fence sections having a plurality of holes therethrough for conducting fluid therefrom to different areas of the ground on at least one side of said fence section.

5. A fence assembly in accordance with claim 4 wherein said holes in said tubular formations of each of said fence sections are provided on both sides of the tubular formations and are located to permit irrigation fluid provided under pressure within the tubular formations to flow outwardly as a plurality of streams of fluid to both sides of the fence sections for irrigating different areas adjacent both sides of said fence sections.

6. A fence assembly in accordance with claim 5 wherein said holes in said tubular formations are so located and shaped to provide a plurality of fine streams of irrigation fluid for substantially blanket irrigation of respective band-like portions of land on both sides of said fence.

7. A fence assembly in accordance with claim 1 including a plurality of spray generating means connected to said fence assembly and each operable to generate a spray of fluid directed thereto through said tubular formation carrying irrigation fluid for irrigating a substantial area of the land adjacent said fence.

8. A fence assembly in accordance with claim 7 wherein at least certain of said spray generating means comprise respective rotatable nozzle means which are operated to rotate when fluid pressure is applied to said tubular formation adapted to carry irrigation fluid for irrigating a substantial area of the land adjacent said fence assembly.

9. A fence assembly in accordance with claim 8 wherein each of said coupling means comprises a unitary molding having an elongated shank means joining said upper and lower connection formations and having an extension below the lower connection formed with a spiked end adapted to be pushed into the ground.

10. A fence assembly in accordance with claim 1 including a spray nozzle connected to the upper end of each of said coupling means and operatively coupled through said coupling means to the upper tubular formations of the adjacent fence sections, means for conducting an irrigation fluid to said upper tubular formations of said fence assembly and to the spray nozzles connected to said coupling means for generating respective sprays of said fluid which fan outwardly from said sections of fence.

* * * * *